US006920300B2

(12) United States Patent
Watanabe et al.

(10) Patent No.: US 6,920,300 B2
(45) Date of Patent: Jul. 19, 2005

(54) IMAGE FORMING APPARATUS CAPABLE OF INHIBITING PHOTORECEPTOR FILMING AND COLOR TONER MIXING

(75) Inventors: Takeshi Watanabe, Ichikawa (JP); Masashi Takahashi, Yokohama (JP); Shinji Aoki, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 13 days.

(21) Appl. No.: 10/385,664

(22) Filed: Mar. 12, 2003

(65) Prior Publication Data

US 2004/0179860 A1 Sep. 16, 2004

(51) Int. Cl.[7] ..... G03G 15/30
(52) U.S. Cl. ..... 399/149
(58) Field of Search ..... 399/149, 302, 399/308

(56) References Cited

U.S. PATENT DOCUMENTS

| | | | | | |
|---|---|---|---|---|---|
| 5,731,122 | A | | 3/1998 | Yoshida et al. | |
| 5,732,314 | A | * | 3/1998 | Tsukida et al. | 399/302 |
| 5,797,070 | A | | 8/1998 | Waki et al. | |
| 6,321,059 | B1 | * | 11/2001 | Tamura | 399/302 |
| 6,438,343 | B1 | * | 8/2002 | Inoue | 399/149 |

FOREIGN PATENT DOCUMENTS

| | | | | |
|---|---|---|---|---|
| JP | 02183276 A | * | 7/1990 | G03G/15/01 |
| JP | 6-274002 A | | 9/1994 | |
| JP | 8-152786 A | | 6/1996 | |
| JP | 09-146334 A | | 6/1997 | |
| JP | 2000-155501 A | | 6/2000 | |
| JP | 2000-235311 A | | 8/2000 | |
| JP | 2000-298388 A | | 10/2000 | |
| JP | 2001-337548 A | | 12/2001 | |

* cited by examiner

*Primary Examiner*—Arthur T. Grimley
*Assistant Examiner*—Ryan Gleitz
(74) *Attorney, Agent, or Firm*—Foley & Lardner LLP

(57) ABSTRACT

An image forming apparatus is provided which is capable of inhibiting filing on photoreceptor and color toner mixing, while prolonging the life of the photoreceptor. The image forming apparatus includes a photoreceptor having a photosensitive surface carrying thereon an electrostatic latent image, a developing device for forming a toner image on the photosensitive surface and electrically recovering toner remaining on the photosensitive surface after image forming operation at the photosensitive surface, a transfer belt 101 having a belt surface which is in contact engagement with the photosensitive surface, and a cleaner S for removing toner attached on the belt surface, wherein the contact angle of the photosensitive surface for water is greater than that of the belt surface for water.

17 Claims, 6 Drawing Sheets

| | TRANSFER PRESSURE | BIAS | COVERAGE RATE | NUMBER OF PRINTS MADE WHEN FILMING HAS OCCURRED |
|---|---|---|---|---|
| YELLOW | 40 g/cm | ABOUT 500V | 50 % | ABOUT 40K PRINTS |
| CYAN | 40 g/cm | ABOUT 500V | 50% | ABOUT 30K PRINTS |
| | 35 g/cm | | | ABOUT 40K PRINTS |
| | 25 g/cm | | | NO FILMING AT 40K PRINTS |
| | | ABOUT 600V | | NO FILMING AT 40K PRINTS |

FIG. 7A

| | TRANSFER PRESSURE | BIAS | COVERAGE RATE | NUMBER OF PRINTS MADE WHEN FILMING HAS OCCURRED |
|---|---|---|---|---|
| YELLOW | 40 g/cm | ABOUT 500V | 95% / 5% ALTERNATED | ABOUT 40K PRINTS |
| CYAN | 25 g/cm | ABOUT 500V | 5% / 95% ALTERNATED | NO FILMING AT 40K PRINTS |
| | | ABOUT 500V | DITTO | NO FILMING AT 40K PRINTS |
| | | 500V/600V CHANGED | DITTO | NO FILMING AT 40K PRINTS |

FIG. 7B

IMAGE FORMING APPARATUS CAPABLE OF INHIBITING PHOTORECEPTOR FILMING AND COLOR TONER MIXING

BACKGROUND OF THE INVENTION

1. Field of the Invention

The present invention relates to an image forming apparatus.

2. Description of the Related Art

Cleanerless process dispensing with a cleaner such as cleaning blade or the like adjacent to the surface of a photoreceptor is advantageous in terms of the miniaturization of apparatuses and toner savings, and technologies for developing with simultaneous cleaning in reversal development have been heretofore disclosed. Such technologies for developing with simultaneous cleaning can be used effectively for the recent full-color image formation by an image forming apparatus and they are going to be employed in 4-unit tandem type image forming apparatuses.

A tandem type image forming apparatus is so constructed that a toner image transferred to a transfer belt or a sheet at an upstream image forming station is rushed as it is to its downstream image forming station. During this rushing, depending on the conditions, part of the toner transferred to the transfer belt or the sheet in the upstream image forming station may be reverse-transferred to the surface of a photoreceptor of the downstream image forming station. If no cleaner is available for cleaning the surface of the photoreceptor, the reverse-transferred toner is collected and recovered into the developing device of the downstream image forming station, with the result that color mixing occurs.

It has been known that the reverse transfer of toner tends to less occur with an increase in toner releasability of the photoreceptor of the downstream image forming station. U.S. Pat. No. 5,797,070 discloses measurement of the toner releasability of the photoreceptor by way of the contact angle of the surface of the photoreceptor for water, as well as an image forming apparatus having a photoreceptor with a surface having a contact angle for water of not less than 85°. Some other relevant prior art publications disclose toner particle diameter distribution based on the relationship between photoreceptor and toner (U.S. Pat. No. 5,731,122) and provision of a brush charger in combination with a photoreceptor (Japanese Patent Application KOKAI Publication No. H8-152786). Further prior art discloses an arrangement of yellow unit at an upstream image forming station so that it is made difficult to recognize color mixing even if such mixing occurs at a downstream image forming station (Japanese Patent Application KOKAI Publication No. H6-274002).

As shown in Japanese Patent Application KOKAI Publications Nos. 2000-235311 and 2000-298388, a system for a tandem type image forming apparatus is proposed wherein a toner image on a photoreceptor is once transferred to an intermediate transfer member, whereupon the toner image is transferred to a sheet. According to this system, the intermediate transfer member has a cleaning member for cleaning the surface of the intermediate transfer member which is in direct contact with the sheet so that ingress of foreign matters such as paper powder into the region of photoreceptor is prevented.

In addition, in an image forming apparatus of cleanerless type which employs a combination of contact electrification by a magnetic brush using mainly magnetic carrier and two-component development using magnetic carrier and toner in the developing device, there is a problem in that the magnetic carrier is attached to the surface of the photoreceptor thereby to scratch the surface. This is due to rotation of the photoreceptor having on the surface thereof carrier which is harder and larger in size than toner and stuck to the surface of the photoreceptor having no cleaner, and this problem tends to occur in an apparatus having a transfer device of contact transfer type. To solve the problem, for example, Japanese Patent Application KOKAI Publication No. 2001-337548 discloses provision of a pressure (linear pressure) between the photoreceptor and the transfer member at 100 g/cm or less.

Although the various provisions have been thus proposed for the solution of the problems associated with toner color mixing and scratching of photoreceptor surface by carrier, the cleanerless process has other problems.

Since the photoreceptor has no cleaner for cleaning its surface in the cleanerless process, abrasion by a cleaner blade dose not occur on the photoreceptor surface even after a long-time use of the photoreceptor and, therefore, the cleanerless process contributes to extended serviceable life of the photoreceptor. On the other hand, however, any hard dirt stuck on the photoreceptor surface cannot be removed. Repeated image forming operation may allow unwanted residual toner on the photoreceptor to adhere its surface, thereby causing a trouble in image forming operation. This trouble is referred to as filming of photoreceptor.

The filming of photoreceptor tends to occur when a process such as contact electrification, contact transfer and contact development in which contact with a photoreceptor takes place is used. Of these, electrification and development in a non-contact or soft contact manner can be performed comparatively easily.

However, the transfer operation is accomplished on the precondition that there is contact between the photoreceptor and the medium to which an image is to be transferred, and, particularly in a four-unit tandem apparatus, the transfer is accomplished through contact of a transfer belt, a paper sheet conveyed by a transfer belt or an intermediate transfer member with the photoreceptor. If there is even a slight difference in surface speed between the photoreceptor and the transfer member or if the pressure to be applied during the transferring is too strong, part of toner and of additive substances to the toner are attached gradually to the surface of the photoreceptor and finally stuck hard on the surface to such an extent that they are difficult to be removed.

Formation of the filming on photoreceptor varies depending on toner composition, as well as the above conditions. The filming tends to occur, for example, when color toners with addition of more external additives are used for reproduction of glossy image or extended color reproduction.

As measures for inhibiting the filming, the above-cited intermediate transfer method may be used wherein an intermediate transfer member having a cleaner for removing paper power is provided so as to prevent paper powder from being attached to the photoreceptor. Although this method can improve the situation to a certain extent, the improvement cannot be said to be enough.

Further measures for preventing the filming on photoreceptor in an image forming apparatus other than the cleanerless type is disclosed by Japanese Patent Application KOKAI Publication No. 2000-155501, according to which the transfer belt is moved in contact with the photoreceptor with a difference in surface speed during the time when image forming operation is not performed, so that dirt is rubbed off from the photoreceptor surface. In such structure, however, the surfaces of the photoreceptor and the transfer belt are susceptible to scratches, which hampers the extended serviceable life of the photoreceptor that is one of the advantages of the cleanerless process.

SUMMARY OF THE INVENTION

The present invention has been made to solve the above problems, and an object thereof is to provide an image forming apparatus which is capable of inhibiting filming on a photoreceptor and color toner mixing, while prolonging the life of the photoreceptor.

In order solve the problems, an image forming apparatus according to the present invention comprises an image carrier having an image carrier surface carrying thereon an electrostatic latent image, a developing device for forming a toner image on the image carrier surface and electrically recovering toner remaining on the image carrier surface after image forming operation at the image carrier, a contact member having a contact surface which is in contact engagement with the image carrier surface, and a cleaner for removing toner attached on the contact surface, wherein the contact angle of the image carrier surface for water is greater than that of the contact surface for water.

As such, toner remaining on the image carrier surface tends to be attached to the contact surface whose toner releasability is lower than that of the image carrier surface and, therefore, the tendency of toner and dirt being attached to the image carrier surface can be reduced. Furthermore, because a cleaner is provided for the contact surface, toner and dirt attached thereto can be easily removed, which helps to effectively inhibit filming on photoreceptor. Thus, an image forming apparatus can be provided which is capable of inhibiting filming on photoreceptor and color toner mixing, while prolonging the life of the photoreceptor.

A further image forming apparatus according to the present invention should preferably be constructed to comprise a plurality of image forming stations each having an image carrier having a movable image carrier surface for carrying thereon an electrostatic latent image and a developing device for forming a toner image on the image carrier surface and electrically recovering toner remaining on the image carrier surface after image forming operation, a contact member having a contact surface which is movable in contact engagement with the image carrier surface of each of the plural image forming stations, and a cleaner for removing toner attached on the contact surface, wherein the contact angle of the image carrier surface for water is greater than that of the contact surface for water.

By so constructing the apparatus, toner remaining on each of the image carrier surfaces of the plural image forming stations tends to be attached to the contact surface whose toner releasability is lower than that of the image carrier surfaces and, therefore, the tendency of toner and dirt being attached to the image carrier surfaces can be reduced. Furthermore, because a cleaner is provided for the contact surface, toner and dirt attached on the contact surface can be easily removed, which helps to effectively inhibit filming on photoreceptor.

In the above image forming apparatus, it should preferably further comprise a transfer bias voltage control for applying a transfer bias voltage in transferring the toner image formed on the image carrier surface, wherein the contact pressure between the image carrier surface and the contact surface of an image forming station located on the upstream side with respect to the moving direction of the contact surface is lower than that of another image forming station located on the downstream with respect to the moving direction of the contact surface, and the transfer bias voltage for the upstream image forming station is greater than that for the downstream image forming station.

Thus, setting the contact pressure lower for the upstream image forming station where there is no fear of reverse transfer than for the downstream image forming station can inhibit formation of filming on photoreceptor at the upstream image forming station, and setting the transfer bias voltage greater for the upstream image forming station than for the downstream image forming station can compensate for a decrease of transfer efficiency which is due to reduction of the contact pressure. That is, filming on photoreceptor can be inhibited without reducing the transfer efficiency.

In the above image forming apparatus, the contact pressure between the image carrier surface and the contact surface of an image forming station located on the upstream side with respect to the moving direction of the contact surface should preferably be greater than that of another image forming station located on the downstream side. In the so-called tandem type image forming apparatus in which a plurality of image forming stations are arranged, a larger quantity of transferred toner will pass through a downstream image forming station than through an image forming station located on the upstream side. In such a case, if toner of the same type is used for both upstream and downstream stations, filming tends to occur more at the developing device of the downstream station.

Therefore, by setting the contact pressure lower for an image forming station on the downstream side than for another image forming station disposed on the upstream side (in other words, by setting the contact pressure for an image forming station higher than that for another image forming station disposed downstream thereof), filming occurring earlier at the downstream station than at the upstream station can be inhibited. In the image forming apparatus in which the contact pressure for the upstream image forming station is set greater than that for the downstream image forming station, there may be provided a transfer bias voltage control for applying a transfer bias voltage in transferring a toner image formed on the image carrier surface so that a transfer bias voltage for application to the upstream image forming station is lower than that to the downstream image forming station. By so doing, it is possible to stabilize the transfer efficiency at the downstream image forming station which is slightly lowered by the decreased contact pressure.

The above image forming apparatus preferably further comprises a transfer bias voltage control for applying a transfer bias voltage in transferring the toner image formed on the image carrier surface, wherein the transfer bias voltage control is operable to apply a voltage, at least one of the voltage value and the polarity thereof being different from the transfer bias voltage, during a time when transferring of the toner image from the image carrier surface is not being performed.

As such, substances (toner, dirt, etc.), which are attached to the image carrier surface by charging and cause filming on photoreceptor, can be easily removed from the image carrier surface, with the result that filming on photoreceptor can be effectively inhibited.

Although the contact member in the above image forming apparatus should preferably include an intermediate transfer member to which the toner image formed on the image carrier surface is transferred and which holds such toner image and then transfers the held toner image to a sheet and the contact surface should be provided by a transfer surface of the intermediate transfer member, the present invention is not limited to such an arrangement, but the contact member may include a transfer roller which is operable to press the sheet against the image carrier surface to transfer the toner image formed on the image carrier surface to the sheet, and the contact surface may be provided by a roller surface of the transfer roller.

Furthermore, the above contact member may include an intermediate transfer belt to which the toner image formed on the image carrier surface is transferred and which holds such toner image and then transfers such toner image to a sheet and the contact surface may be provided by belt surface of the intermediate transfer belt.

In the above image forming apparatus, it should preferably further comprise a transfer bias voltage control for applying a transfer bias voltage in transferring the toner image formed on the image carrier surface, wherein, when the coverage rate at an image forming station located on the upstream side with respect to the moving direction of the contact surface is higher than that at another image forming station located on the downstream side with respect to the moving direction of the contact surface, the transfer bias voltage control is operable to apply to the downstream image forming station a transfer bias voltage which is lower than that applied to the upstream image forming station.

By setting the transfer bias voltage in the downstream image forming station lower than that in the upstream image forming station when the coverage rate at the upstream image forming station is higher than that at the downstream image forming station (or in case of printing an image of such a type that tends to cause color mixing), occurrence of reverse transfer due to a high transfer bias voltage can be inhibited and hence color toner mixing can be prevented.

Furthermore, in the above image forming apparatus, it may further comprise a transfer bias voltage control for applying a transfer bias voltage in transferring the toner image formed on the image carrier surface, wherein, when the coverage rate at an image forming station located on the upstream side with respect to the moving direction of the contact surface is lower than that at another image forming station located downstream thereof as seen in the moving direction of the contact surface, the transfer bias voltage control may be operable to apply to the downstream image forming station a transfer bias voltage which is higher than that applied to the image forming station upstream thereof.

By setting the transfer bias voltage in the downstream image forming station higher than that in the upstream image forming station when the coverage rate at the upstream image forming station is lower than that at the downstream image forming station (or in case of printing an image of such a type that does not tends to cause color mixing), occurrence of reverse transfer due to a high transfer bias voltage can be prevented and hence color toner mixing can be prevented.

Additionally, in the above-described embodiment, the contact pressure in terms of line pressure between the image carrier surface and the contact surface should preferably be 1 g/cm or more, but less than 50 g/cm.

DESCRIPTION OF THE DRAWINGS

FIG. 7A is a table showing the results of test conducted under varying conditions of transfer pressure and transfer bias voltage; and FIG. 7B is a table showing the results of test conducted under varying conditions of transfer pressure and transfer bias voltage.

DESCRIPTION OF THE PREFERRED EMBODIMENTS

The following will describe embodiments of the image forming apparatus of the present invention with reference to the accompanying drawings.

(First Embodiment)

The following will describe in detail a first embodiment of the image forming apparatus of the invention.

Figure 1:
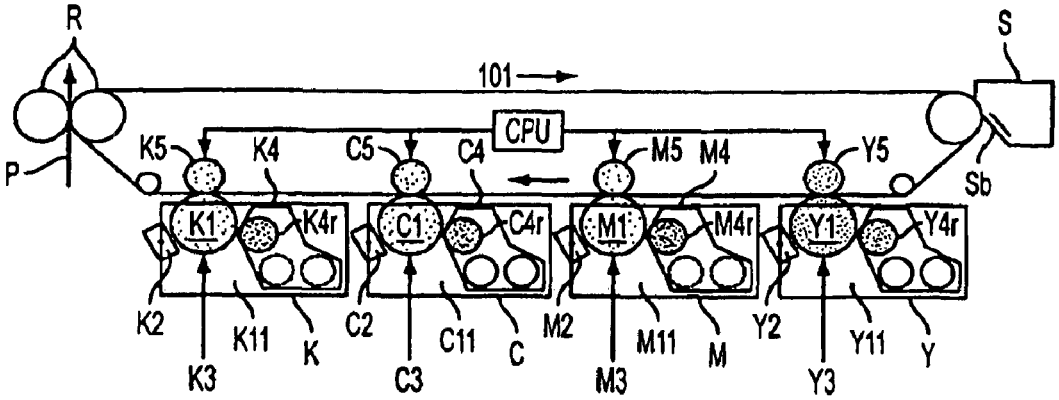
FIG. 1 is a schematic illustration showing peripheral arrangement of image forming stations of an embodiment of an image forming apparatus according to the present invention.

FIG. 1 shows schematically the peripheral arrangement of image forming stations of the embodiment of image forming apparatus of the present invention. The image forming apparatus in the illustrated embodiment is a so-called tandem type image forming apparatus which makes possible formation of a color image. In this image forming apparatus, yellow image forming station Y, magenta image forming station M, cyan imaging forming station C and black image forming station K are arranged substantially in parallel to the rotating direction of a transfer belt 101 (transfer member) (moving direction of the transfer surface of the transfer belt). Adjacent to the belt surface of the transfer belt 101 is provided a cleaning device S having a cleaning blade Sb for mechanically removing toner particles and paper powder attached on the belt surface.

Photoreceptor (image carrier) Y1 of the image forming station Y at the first unit (or the station at the uppermost-stream side as seen in the moving direction of the belt surface (contact surface) of the transfer belt (contact member) 101) is a photoreceptor drum having an organic or amorphous silicon photosensitive layer formed on a conductive substrate.

The photoreceptor Y1 is charged uniformly for example to −500 V by a charger Y2 and then subjected to exposureY3 by an image-modulated laser beam or LED from a not shown exposure device, thus an electrostatic latent image being formed on the photosensitive surface (image carrier surface). As the charger Y2, known roller, corona or scorotron charger may be used.

The potential on the surface of the photoreceptor thus subjected to the exposure becomes about −80 V. Then, the electrostatic latent image is visualized by the developing device Y4. This developing device Y4 is of a two-component developing type using mixture of negatively charged nonmagnetic toner and magnetic carrier, and chains of carrier are formed on the surface of the developing roller Y4*r* having a magnet, and then a voltage of −200 to 400 V is applied to the developing roller Y4*r*. Thus, toner is attached to the exposed portion of the photoreceptor surface while no toner is attached to the non-exposed portion of the surface.

Figure 8:
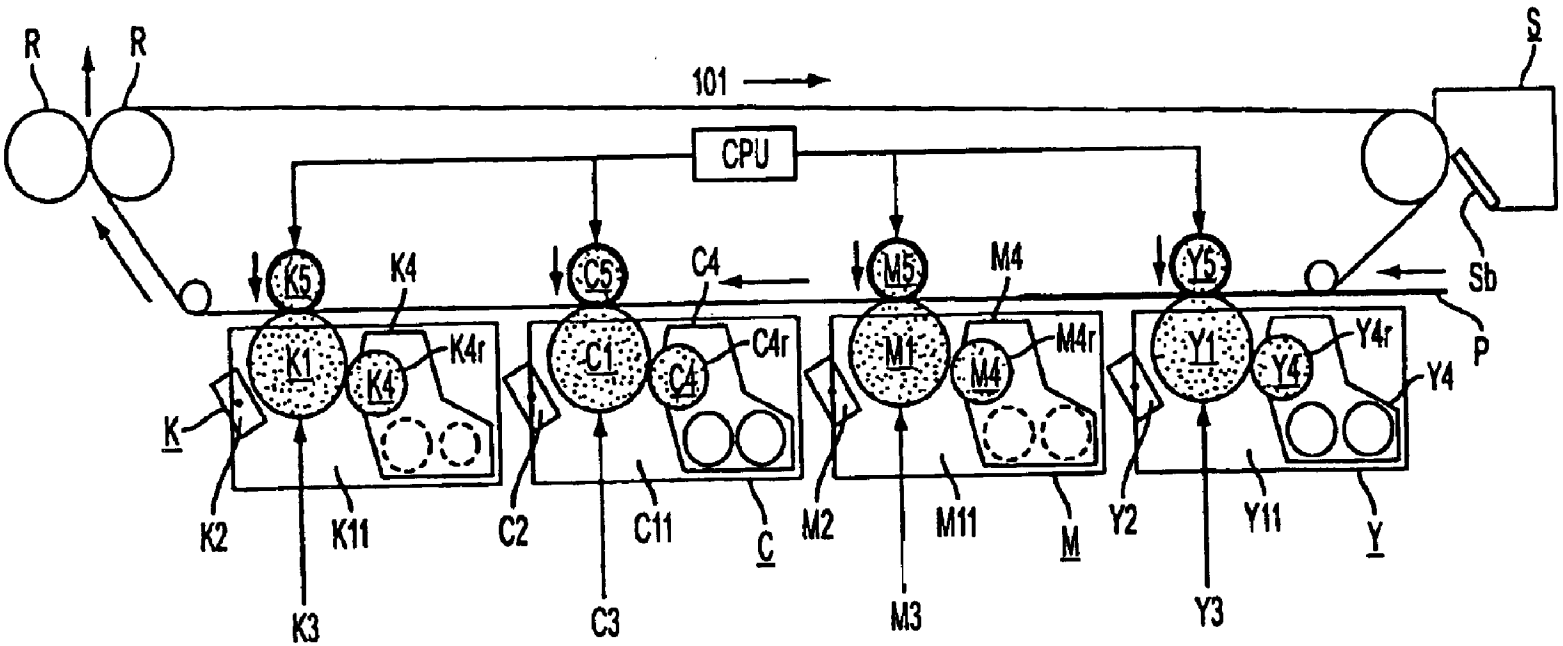
FIG. 8 is a schematic illustration showing peripheral arrangement of image forming stations of another embodiment of an image forming apparatus according to the present invention.

The visualized image formed on the photosensitive surface of photoreceptor Y1 is transferred to a sheet conveyed by the transfer belt (intermediate transfer member) 101 as the transfer member (See FIG. 8 ) or to the belt surface (contact surface) of the transfer belt 101 (See FIG. 1 ). In the case of the image being transferred to the belt surface of the transfer belt 101, the transfer belt serves as an intermediate transfer belt and a sheet P to which the toner image is to be transferred is held between and conveyed by a pair of rollers R around one of which the transfer belt 101 is trained. The toner image formed on the transfer belt is transferred to the sheet P while the sheet P is being held between the paired rollers R.

Supply of electric field during the transferring is accomplished via a transfer roller Y5 which is disposed in contact with the backside of the transfer belt 101 (the side thereof facing away from the photoreceptor Y1). The voltage for application to the transfer roller Y5 is about 300 V to 3 kV. This voltage is referred to as transfer bias voltage. The magnitude and polarity of this transfer bias voltage is controlled by a not shown CPU incorporated in the apparatus.

Residual toner, etc. remaining on the photosensitive surface of the photoreceptor Y1 after transferring operation is removed, if necessary, by erasing memory of transfer residual image (after image) by using a blending member, and the above step of charging is repeated after the photoreceptor has been decharged appropriately.

Since the residual toner on the photoreceptor passing by the charger Y2 has undergone the charging step, the residual toner is charged in the same polarity of the charge potential of the photoreceptor (or charged negatively in the embodiment). As the residual toner on the photosensitive surface reaches the developing device Y4, the portion for image subjected to the exposure Y3 is developed with the toner attached on the photosensitive surface, while the residual toner on the portion which was not subjected the exposure Y3 and hence where image will not be formed is electrically recovered to the developing roller Y4*r* of the developing device Y4. This operation is the so-called developing with simultaneous cleaning.

This cleaning with simultaneous developing makes possible continuous electrophotographic process at the first image formation station Y without using a cleaning blade provided adjacent to the photosensitive surface of the photoreceptor Y1.

The following will describe the second image forming station M. Structure of the second image forming station M is the same as the first image forming station, having a photoreceptor M1, charger M2, exposure device (not shown) for exposure M3, developing device M4 and transfer roller M5.

The image which has been formed by the previous image forming station Y and transferred to the belt surface of transfer belt or to a sheet is allowed to move to the photoreceptor M1 of the second image forming station M. Depending on conditions, phenomenon of part of the tone for the image formed at the first image forming station M being reverse-transferred to the photoreceptor M1 of the second image forming station may take place.

Because the toner transferred to the transfer belt or sheet is of negative polarity and the transfer roller M5, etc. are charged with a positive voltage of about 300 V to 3 kV during transferring operation at the second image forming station M, normally the toner (yellow) of the first image forming station Y would not be moved from the transfer belt or sheet.

If a phenomenon of abnormal discharging or charge injection occurs at the transfer roller, etc., however, part of the toner is reverse-charged, or positively charged thereby to become positive, with the result that such toner may be attached to the photosensitive surface of the photoreceptor M1 at the second image forming station M. The toner for the first image forming station Y thus attached to the photosensitive surface is charged back negatively by the charger M2 in the same manner as in the case of charging at the first image forming station, and recovered into the developing device M4, thus causing color mixing.

Although it is so arranged that the moving speeds of those portions of the belt surface of transfer belt and the photosensitive surface of photoreceptor which are in contact with each other are substantially the same, a slight difference in the speed may result from any eccentricity of the photoreceptor or irregular movement of the transfer belt. If the pressing force of the transfer roller is then large, stress of the toner present between the transfer roller and the photosensitive surface of photoreceptor is increased, so that toner surface may be melt and the toner attached to the photosensitive surface of photoreceptor or to the transfer belt.

If image forming operation is continued for a long time in such a state, the toner attached to the belt surface of transfer belt or the photosensitive surface of photoreceptor becomes hard to be removed readily (i.e., filming on photoreceptor). If a mechanical cleaning device such as blade is provided adjacent to the photosensitive surface of a conventional photoreceptor, the toner attached on the photosensitive surface may be rubbed off therefrom and, therefore, filming on photoreceptor tend to less occur, but deterioration of the photosensitive surface is hastened because of gradual abrasion of the photosensitive surface.

On the other hand, in an image forming apparatus such as the present embodiment wherein no cleaning device is provided adjacent to the photosensitive surface of photoreceptor and, therefore, no means is available for rubbing off the toner melted and adhering to the photoreceptor, toner which cannot be removed by the action of electric field of the developing device is deposited gradually on the photosensitive surface, eventually forming hard filming on photoreceptor.

In the present embodiment of image forming apparatus, it is so arranged that toner releasability of the photosensitive surface is greater than that of the belt surface of transfer belt to inhibit attachment of melted toner to the photosensitive surface of photoreceptor. The following will describe more in detail the setting of toner releasability.

The photosensitive surface of the photoreceptor is so constructed that it uses a layered phthalocyanine-based organic photoreceptor. For increased toner releasability, silicon-based material is mixed in the carrier transport layer (CTL) of the photoreceptor.

Experiment was conducted to make sure of the effects variable by changing the toner releasability of the photosensitive surface of photoreceptor. For the purpose of the experiment, a plurality of photoreceptors having different levels of toner releasability, i.e. different ratios of silicon material contained in CTL, was prepared. Prototype photoreceptors made for the experiment had silicon material was distributed in the direction of the film such that it is localized adjacent to the surface. When CTL of the photosensitive surface of photoreceptor is abraded slightly, the toner releasability is reduced because the ratio of silicon content is less in the middle portion of CTL. Consequently, simulated life test was conducted by performing blade cleaning for each of the prototype photosensitive surfaces to measure the extent of abrasion of CTL, and then comparison of the toner releasability was made by way of measuring the contact angles of the photoconductive surface for purified water for each abrasion measurement of CTL.

Simulated life test was conducted for printing thousands of sheets even in the initial state so that a great difference in surface roughness would not occurs. In the state where initial film abrasion occurred very little, the contact angle of the photosensitive surface for purified water was about 100°. Such photosensitive surface was cut by abrasion in the simulated life test, and different photoreceptors were made having 95°, 90°, 85°, 80° and 75° of contact angle of the photosensitive surface for purified, respectively.

For the transfer belt, on the other hand, a polyimide single-layer belt was used. The thickness was about 50 to 20 μm. The resistance was 10e8 to 10e12 ohm cm for the type in which a sheet is supported on the belt surface of transfer belt and transferring is performed directly from the photoreceptor and 10e6 to 10e10 ohm cm for the so-called intermediate transfer type in which image is firstly transferred to the belt surface of transfer belt and further transferred therefrom to a sheet or a second transfer member. The polyimide belt used for the experiment had about 83° of contact angle of its belt surface for purified water. A polyimide transfer belt with a coating of about 2 to 5 μm of fluorine-based material was also used (with about 92° of contact angle for purified water).

The experiment was made using a belt of intermediate transfer type with a resistance of about 10e8 cm. Polyester-based ground toner with an average diameter of 6 μm was used. For the sake of improvement of transfer efficiency, the toner was heat treated after being ground so as to slightly improve the sphericity of toner particles.

Figure 2:
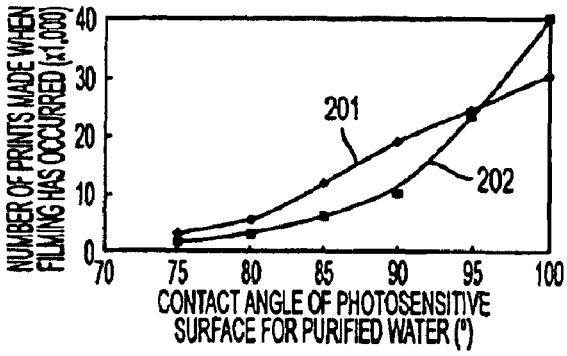
FIG. 2 is a diagram showing the relation between the contact angle of the photosensitive surface for purified water and the number of prints made when filming has occurred.

Photoreceptors and transfer belts were thus prepared and filming test was conducted under various combinations of different conditions for comparison of filming inhibiting effects. Experimental results are shown in FIG. 2. The diagram of the drawing shows the relation between the contact angle (°) of the photosensitive surface for purified water and the number of prints made when filming occurred.

The filming experiment was conducted by continuously printing solid images on sheets. Transfer bias voltage was adjusted so that developing quantities at the developing device and transfer efficiencies become substantially the same under all conditions. Intermediate transfer belt was used for image transfer to a sheet, and it was so set that the developing quantity of solid image to the photosensitive surface was 0.5 to 0.6 mg/cm and the transfer efficiency 91 to 93%, respectively. The transfer bias voltage was controlled by a CPU (not shown) incorporated in the image forming apparatus.

As a result, when a polyimide belt with a contact angle of 83° for purified water was used (depicted by 201 in the diagram), no filming occurred after continuously printing 15,000 sheets in case of contact angles 90°, 95° and 100° of the photoreceptor, while filming resulted from printing less than 10,000 sheets in case of contact angles 80° and 75° of the photoreceptor. Although it is unlikely that solid printing is continued continuously on as many as 10,000 sheets, it would be necessary for a photoreceptor to resist printing more than 100,000 sheets in view of the need of extended serviceable life of photoreceptor. Supposing that the filming occurs in proportional relation to coverage rate (or the ratio of printed area on a sheet to the total area of the sheet), 188,000 sheets each having an image of 8% coverage rate correspond to solid-printed 15,000 sheets.

Since normal life of a photoreceptor is about 60,000 sheets and twice the normal life, i.e. about 120,000 sheets, is set as standard for the purpose of experiment, about 90,000 sheets can be guaranteed as nominal life if the photoreceptor can resist solid printing on about 15,000 sheets. In other words, if no filming occurs in the experiment after printing on about 15,000 sheets, the purpose of extending the photoreceptor life (inhibition of filming on photoreceptor) could be achieved.

When the intermediate transfer belt having a surface layer of fluorine-based material with a contact angle of 92° for purified water was used (depicted by 202 in FIG. 2), no filming occurred after printing 15,000 sheets in case of contact angles 100° and 95° of the photoreceptor, while filming resulted from printing less than 10,000 sheets in case of contact angle of not more than 90° of the photoreceptor.

As appreciated from the experimental results of FIG. 2, increased toner releasability of the transfer belt is not necessarily desirable, but what is important is that the releasability of the photosensitive surface of photoreceptor should be greater than that of the belt surface of transfer belt.

That is, the experimental results show that filming on photoreceptor tends to less occur as the toner releasability of the photosensitive surface is increased while maintaining the desirable relationship of the releasabilities between the photosensitive surface and the belt surface.

According to the image forming apparatus of the present embodiment, toner remaining on the photosensitive surface tends to be attached more to the transfer belt whose releasability is lower than that of the photosensitive surface, with the result that toner and dirt tend to remain less on the photosensitive surface. Furthermore, as shown in FIG. 1, the cleaning device S located adjacent to the belt surface of the transfer belt 101 can help to remove toner and dirt attached to the belt surface.

If substances attached on photosensitive surface and causing filming on the photosensitive surface are positively charged, such substances may remain to be attached for a long period of time by the action of electrical field even if the photosensitive surface and the belt surface have different releasability as mentioned above. In such a case, periodically changing the transfer bias voltage for application to the transfer belt while no image forming operation is being performed can effectively inhibit filming.

More specifically, transfer bias voltage to the belt surface of transfer belt may be changed during preparatory time or after each continuous print of tens of sheets so that the direction of electric filed of the photosensitive surface and the belt surface is reversed for a given length of time. In the experiment, application of a voltage of −1,000 V to the transfer roller during its five turns after solid printing on each 50 sheets showed good results of filming inhibition.

Figure 3:
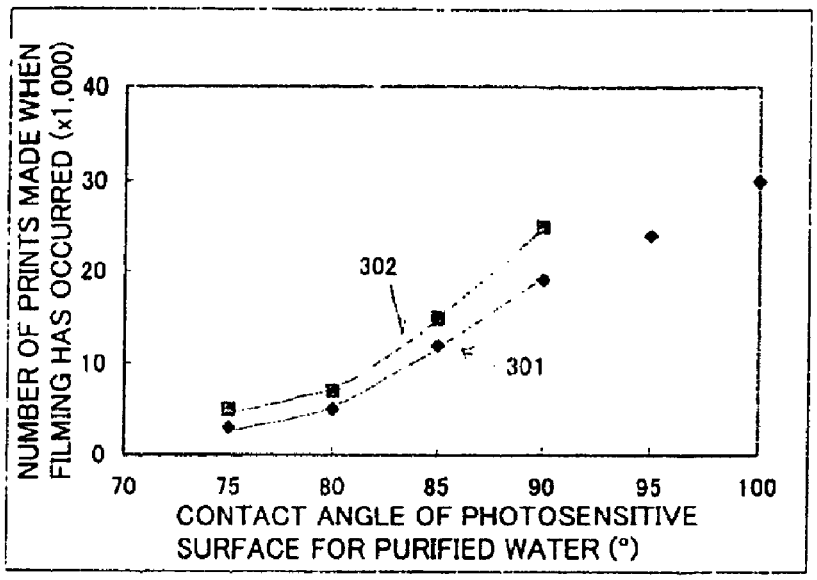
FIG. 3 is a diagram showing the relation between the contact angle of the photosensitive surface for purified water and the number of prints made when filming has occurred.

FIG. 3 shows the experimental results when the transfer bias voltage was changed as mentioned above. The diagram in this drawing shows the relation between the contact angle (°) of the photosensitive surface for purified water and the number of prints made when filming occurred. As appreciated from the diagram, reference numeral 302 represents data obtained when the transfer bias voltage was changed, while 301 represents data obtained when printing test was performed without changing the transfer bias voltage. It can be seen from these results that changing the transfer bias voltage in the manner as mentioned above can effectively inhibit filming.

As described above, the image forming apparatus of this embodiment comprises a photoreceptor having a photosensitive surface carrying thereon an electrostatic latent image, a developing device for forming a toner image on the photosensitive surface and electrically recovering toner remaining on the photosensitive surface after image forming operation at the photosensitive surface, a transfer belt having a belt surface which is in contact engagement with the photosensitive surface, and a cleaner for removing toner attached on the belt surface, wherein the contact angle of the photosensitive surface for water is greater than that of the belt surface for water.

As such, toner remaining on the photosensitive surface tends to be attached to the belt surface whose toner releasability is lower than that of the photosensitive surface and, therefore, the tendency of toner and dirt being attached to the photosensitive surface can be reduced. Furthermore, because a cleaner is provided for the belt surface, toner and dirt attached thereto can be easily removed, which helps to effectively inhibit filming on photoreceptor.

Additionally, an image forming apparatus according to the present invention should preferably comprise a plurality of image forming stations each having a photoreceptor having a movable photosensitive surface carrying thereon an electrostatic latent image and a developing device for forming a toner image on the photosensitive surface and electrically recovering toner remaining on the photosensitive surface after image forming operation, a transfer belt having a belt surface movable in contact engagement with the photosensitive surface of each of the plural image forming stations, and a cleaner for removing toner attached on the belt surface, wherein the contact angle of the photosensitive surface for water is greater than that of the belt surface for water.

By so constructing the apparatus, toner remaining on each of the photosensitive surfaces of the plural image forming stations tends to be attached to the belt surface whose toner releasability is lower than that of the photosensitive surfaces and, therefore, the tendency of toner and dirt being attached to the photosensitive surfaces can be reduced. Furthermore, because a cleaner is provided for the belt surface, toner and dirt attached on the belt surface can be easily removed, which helps to effectively inhibit filming on photoreceptor.

In other words, the image forming apparatus of the present embodiment has at least one contact member such as transfer roller, transfer belt and charger, which contact member is disposed in contact with the photosensitive surface and the toner releasability of which is lower than that of the photosensitive surface, and a cleaning member is provided for the contact member. By so constructing the apparatus, it can be made possible to inhibit filming on photoreceptor.

Furthermore, periodically reversing the direction of electric field acting between the surface of the above contact member and the photosensitive surface (or providing a mode in which during non-image forming operation electric field acts between the photosensitive surface and the belt surface in the direction reverse to that of the electric field acting during image forming operation) can further effectively inhibit filming on photoreceptor.

Alternatively, an image forming apparatus of the present invention may comprise a photoreceptor carrying thereon an electrostatic latent image, a developing device for forming an image with toner, and a transfer member for transferring the developed toner image to a medium to which the image is to be transferred (corresponding to a member such as transfer roller or intermediate transfer belt which is in contact engagement with the photosensitive surface), said developing device serving also as a cleaning device for recovering toner remaining on the photosensitive surface after the image forming operation, further comprising at least one contact member other than the developing device, the transfer member having a cleaner, and the contact angle of the photosensitive surface for water being greater than that of the surface of the transfer member for water.

(Second Embodiment)

The following will describe in detail a second embodiment of image forming apparatus according to the present invention. This embodiment is a modification of the above-described first embodiment, and its structure as an image forming apparatus is substantially the same as that of the first embodiment. Therefore, those descriptions which have been already made with reference to the first embodiment will be omitted.

As already mentioned in earlier part hereof, rubbing contact between the photosensitive surface of photoreceptor and the belt surface of transfer belt is one of the causes of filming on photoreceptor.

A major factor in the stress applied to toner is the contact pressure between the photosensitive surface of a photoreceptor and the belt surface of a transfer belt (contact pressure hereinafter). With a decrease in the contact pressure, the stress to the toner or to the photoreceptor is reduced, and hence the tendency of filming on photoreceptor can be also reduced, although an excessive decrease of the contact pressure will reduce transfer efficiency. If transfer bias voltage is stepped up under such a reduced transfer efficiency, the quantity of reverse-transferred toner tends to disadvantageously increase.

Figure 4:
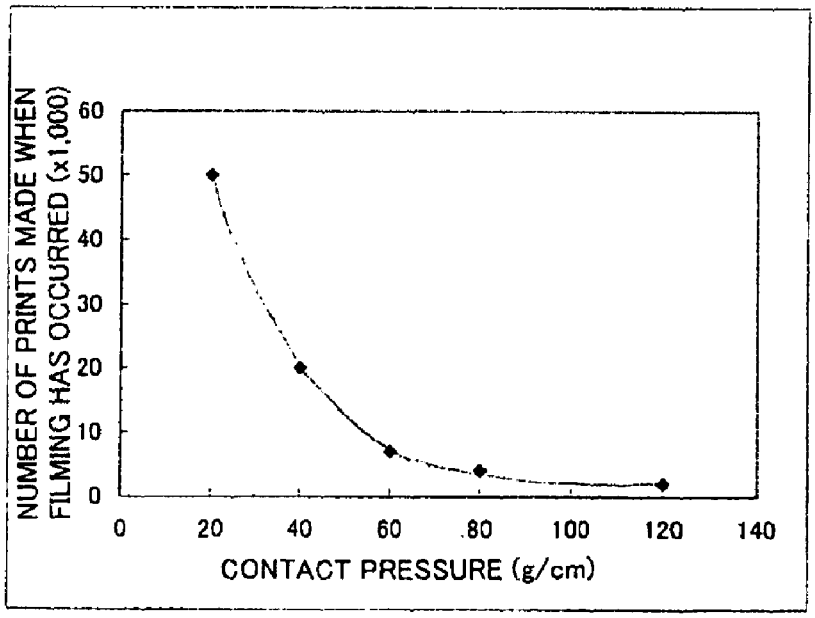
FIG. 4 is a diagram showing the relation between the contact pressure between the photosensitive surface of photoreceptor and the belt surface of transfer belt and the number of prints made when filming has occurred.

FIG. 4 shows the relation between the contact pressure between the photosensitive surface of photoreceptor and the belt surface of transfer belt and the number of prints made when filming has occurred. The contact pressure between the photosensitive surface of photoreceptor and the belt surface of transfer belt was adjusted by changing the pressing force of the transfer roller which is arranged in contact with the back side of the transfer belt (i.e., the side facing away from the photosensitive surface). The transfer roller is a sponge roller with a diameter of 14 mm and a resistance of 10e5 to 10e9 cm resistance. A transfer belt with a contact angle of 83° for purified water and a photoreceptor with a contact angle of 85° for purified water were employed.

As shown in the figure, in the range of contact pressures greater than 60 g/cm (line pressure) between the photosensitive surface and the belt surface, filming occurred from printing less than 10,000 sheets while no filming occurred even after printing 15,000 sheets in the range of contact pressures not greater than 40 g/cm. It can be appreciated from such results that the photoreceptor can resist about 15,000 prints when the line pressure is at about 50 g/cm or less.

Figure 5:
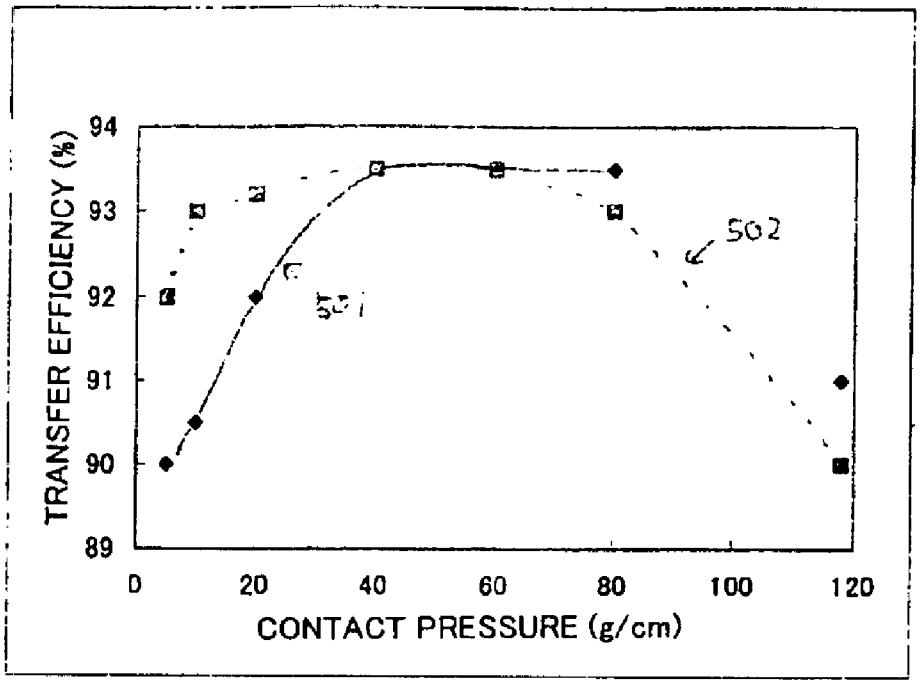
FIG. 5 is a diagram showing the relation between the contact pressure between the photosensitive surface of photoreceptor and the transfer belt surface and the transferring efficiency.

FIG. 5 shows the relation between the contact pressure between the photosensitive surface of photoreceptor and the belt surface of transfer belt and the transfer efficiency, wherein the measurements were made under application of two different transfer bias voltages. The diagram shows that the transfer efficiency could be improved even with a low contact pressure when the transfer bias voltage was set at a higher value (depicted by 502 in FIG. 5), as compared with the case of application of normal transfer bias voltage (depicted by 501 in FIG. 5). In other words, as compared with the data obtained under application of normal transfer bias voltage, the data under application of increased transfer bias voltage is shifted toward the side where optimum line pressure is reduced.

Figure 6:
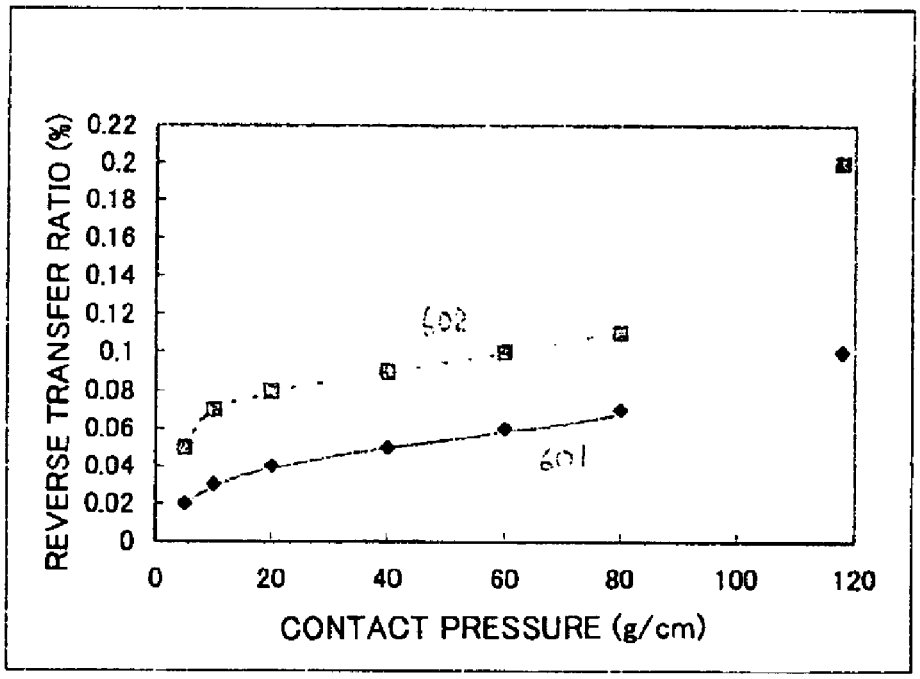
FIG. 6 is a diagram showing the relation between the reverse-transfer ratio and the contact pressure between the photosensitive surface and the belt surface in an experiment conducted under the same conditions as in the case of FIG. 5.

FIG. 6 shows the relation between the reverse-transfer ratio and the contact pressure between the photosensitive surface and the belt surface in an experiment made under the same conditions as in the case of FIG. 5. As appreciated from the diagram, reverse transfer tends to occur more under application of a higher transfer bias voltage (depicted by 602 in FIG. 6) than under application of a normal transfer bias voltage (depicted by 601 in FIG. 6) and it also tends to occur more with an increase of line pressure.

Since no reverse transfer takes place in the first image forming station of the image forming apparatus of tandem type as shown by the present embodiment, a high transfer bias voltage may be set for the first image forming station and, therefore, the contact pressure therefor may be set high, accordingly. Such settings of the transfer bias voltage and the contact pressure help to inhibit filming on photoreceptor at the first image forming station.

An experiment was conducted to evaluate the transfer efficiency under the above settings for transfer bias voltage and contact pressure. When the transfer bias voltage for the first image forming station was set higher than that for the second image forming station by about +100 V, transfer efficiency over 93% was accomplished under a contact pressure of 20 g/cm. According to the results of filming test under the same conditions, filming on the photosensitive surface occurred at the second image forming station by printing less than 10,000 sheets under a contact pressure of 40 g/cm, while filming on the photosensitive surface did not occur at the first image forming station even after printing 15,000 sheets, thus filming on the photosensitive surface being inhibited while achieving the same level of transfer efficiency.

As described above, the image forming apparatus of tandem type of the present embodiment having a plurality of image forming stations each comprising a photoreceptor carrying thereon an electrostatic latent image, a charger for charging uniformly a photosensitive surface of the photoreceptor, a developing device for developing the electrostatic latent image with toner, a transfer device (such as transfer roller or intermediate transfer belt) for transferring for transferring the developed toner image to a medium to which the image is to be transferred, said developing device performing a function of a cleaner for recovering toner remaining on the photoreceptor after transferring and for cleaning, wherein the transfer device has a transfer surface (such as roller surface or belt surface) in operative contact with the photoreceptor, the contact pressure between the photosensitive surface and the transfer surface for a transfer device of an image forming station is lower than that for a transfer device of an image forming station located downstream thereof, and the electric field intensity (which corresponds to transfer bias voltage) applied to a transfer device of an image forming station is greater than that applied to a transfer device of an image forming station located downstream thereof.

In the image forming apparatus of tandem type of the present embodiment wherein the contact pressure for the upstream image forming station is set lower than that for the downstream image forming station and the electric field intensity for the upstream image forming station is set greater than that for the downstream image forming station, filming on photoreceptor at the upstream image forming station can be inhibited.

In the above-described image forming apparatus, it is desirable that there should be provided a transfer bias voltage control for applying a transfer bias voltage in transferring a toner image formed on the photosensitive surface, the contact pressure between the photosensitive surface and the belt surface for an image forming station is lower than that for an image forming station located downstream as seen in the moving direction of the belt surface, and that the transfer bias voltage for the upstream image forming station is greater than that for downstream image forming station.

Thus, setting the contact pressure lower at the upstream image forming station where there is no fear of reverse transfer than at the downstream image forming station can inhibit the formation of filming on photoreceptor at the upstream image forming station, and setting the transfer bias voltage greater at the upstream image forming station than at the downstream image forming station can compensate for a decrease of transfer efficiency which is due to reduction of the contact pressure. That is, filming on photoreceptor can be inhibited without significantly reducing the transfer efficiency.

(Third Embodiment)

The following will describe in detail a third embodiment of image forming apparatus according to the present invention. This embodiment is a modification of the above-described respective embodiments, but the structure as an image forming apparatus is substantially the same as that of the above embodiments. Therefore, those descriptions which have been already made with reference to the above-described respective embodiments will be omitted.

In the so-called tandem type image forming apparatus in which a plurality image forming stations is arranged, a larger quantity of transferred toner will be passed to an image forming station than to an image forming station located upstream thereof. In such a case, if toner of the same type is used for both upstream and downstream image forming stations, filming tends to occur more at the developing device of the downstream image forming station.

Consequently, by setting the contact pressure lower for the downstream image forming station than for the upstream image forming station, earlier occurrence of filming on photoreceptor at the downstream image forming station than at the upstream image forming station can be inhibited. In this case, setting the transfer bias voltage for the downstream image forming station slightly higher than that for the upstream station can inhibit the occurrence of filming on photoreceptor while stabilizing the transfer efficiency, but the quantity of reverse-transferred toner may be increased slightly.

Therefore, the transfer bias voltage for the downstream image forming station may be varied depending on the image to be printed. That is, in the case of an image which tends to have color mixing (or an image which uses more toner of the upstream image forming station than that of the downstream image forming station), the transfer bias voltage for the downstream image forming station is not increased so as to minimize the occurrence of reverse transferring. In the case of an image which does not tend to have color mixing, on the other hand, the transfer bias voltage for the downstream image forming station is set higher than that for the upstream image forming station so as to maintain the transferring stability. Tables in FIGS. 7A and 7B provide the results from experiment conducted to ascertain the effects from such settings.

Using a full-color image forming apparatus of tandem type as described with reference to the first embodiment, print test was conducted under a contact pressure (line pressure) of 40 g/cm for the first forming station (yellow) and two different contact pressures of 40 g/cm and 35 g/cm for the third image forming station (cyan), as shown in FIG. 7A. Life test was made with coverage rate of yellow set at 50% and coverage rate of cyan in the region where color superimposition would not occur set at 50%, and changing the yellow and cyan printing regions after each print. According to the experimental results, filming occurred on the photoreceptor at the first image forming station (yellow) when about 40,000 sheets were printed, while, with the contact pressure set at 40 g/cm, the filming occurred at the third image forming station (cyan) when about 30,000 sheets were printed.

With the contact pressure for the third image forming station (cyan) set at 35 g/cm, however, filming did not occur until about 40,000 sheets were printed, that is, substantially the same life could be achieved as the first image forming station (yellow).

It can be thus appreciated that lowering the contact pressure for the third image forming station caused a slight decrease in the transfer efficiency, but it helped to slightly decrease the reverse transfer, thus exhibiting an effect not only to inhibit color mixing but also to inhibit filming on photoreceptor.

When it is desired not to reduce the transfer efficiency, transfer bias voltage for the downstream image forming station should be set at a higher value. As indicated in the table, experiment was made with the contact pressure for the third image forming station (cyan) lowered to 25 g/cm and the transfer bias voltage stepped up by 100 V to 600 V. According to the experimental results, filming on photoreceptor did not occur even after printing 40,000 sheets, thus the lowered transfer pressure exhibited an effect to inhibit the filming. Additionally, the transfer efficiency could be maintained 93% or more. Because increasing the transfer bias voltage in turn increased the quantity of reverse-transferred toner, however, the above setting is not adequate for such an image that is susceptible to the influence of color mixing.

That is, for such an image in an upstream image forming station (or the first image forming station in the present embodiment), whose coverage rate is relatively high and which tends to have color mixing, it is desirable that the transfer bias voltage at a downstream image forming station (or the third image forming station in the present embodiment) should not be decreased, while only for such an image in the upstream image forming station, whose coverage rate is relatively low, the transfer bias voltage at the downstream image forming station should be set at a high level.

As indicated in FIG. 7B, print test was conducted in such a manner that printing at the first image forming station (yellow) with 5% coverage rate and at the third image forming station (cyan) with 95% coverage rate and printing at the first image forming station (yellow) with 95% coverage rate and at the third image forming station (cyan) with 5% coverage rate were made alternately repeatedly.

In this print test, the transfer bias voltage was set higher at the third image forming station C than at image forming stations for the other colors during printing with 5% for yellow and 95% for cyan, and the transfer bias voltage at the third image forming station C was set the same as those at the other image forming stations during printing with 95% for yellow and 5% for cyan. When the transfer bias voltage was not changed from the beginning, the transfer bias voltage for cyan was low and the transfer efficiency was also low during initial period of the testing, with the result that exposure memory (or an after image of previously printed image) tended to occur. When the transfer bias voltage was set high from the beginning, on the other hand, reverse transfer was increased, so that color mixing tended to occur faster.

According to the present invention, in case of printing an image having a relatively low likelihood of color mixing, an image of high quality having little exposure memory can be reproduced, while in case of printing an image which is susceptible to color mixing, such color mixing can be inhibited, but at a slight sacrifice of image quality. As a matter of course, the present invention can exhibit a remarkable effect of inhibiting filming on photoreceptor.

Although each of the above-described embodiments shows a structure by way of an example wherein a toner image is transferred from a photoreceptor to an intermediate transfer belt or the like (or intermediate transfer method), the present invention is not limited to such embodiments, but it is needless to say that the same effects are obtainable from a structure in which a toner image is transferred directly from a photoreceptor to a sheet. Because the photosensitive surface and the belt surface are in direct contact with each other while a sheet is neither held therebetween nor transported thereby, foreign matters attached on the photosensitive surface are moved onto the belt surface during such contact, so that filming on photoreceptor can be reduced. Also in this case, it is needless to say that periodical reversing the direction of electrical field between the belt surface and the photosensitive surface can effectively inhibit filming on photoreceptor.

As the sheet on which an image is reproduced by each of the above-described embodiments of the image forming apparatus, various kinds of sheets such as copying paper, OHP sheet, etc. may be used.

In the image forming apparatus of the present invention, the contact pressure between the photosensitive surface and the belt surface in an image forming station should preferably be greater than that in an image forming station located downstream thereof as viewed in the moving direction of the belt surface. In the image forming apparatus of the so-called tandem type having a plurality of image forming stations, a greater quantity of transferred toner will be passed to the downstream image forming station than to the upstream image forming station. In such a case, if toners of the same kind are used, filming tends to occur more in the downstream image forming station.

By setting the above contact pressure lower at an image forming station than at an image forming station disposed upstream thereof (in other words, by setting the contact pressure at an image forming station higher than that at another image forming station disposed downstream thereof), earlier occurrence of filming at the a downstream station than at the upstream station can be inhibited. In the image forming apparatus in which the contact pressure at the upstream image forming station is set greater than that at the downstream image forming station, there may be provided a transfer bias voltage control for applying a transfer bias voltage in transferring a toner image formed on the photosensitive surface so that a transfer bias voltage for application to the upstream image forming station is lower than that to the downstream image forming station. By so constructing the apparatus, it becomes possible to stabilize the transfer efficiency at the downstream image forming station which is slightly lowered by the decreased contact pressure.

Figure 9:
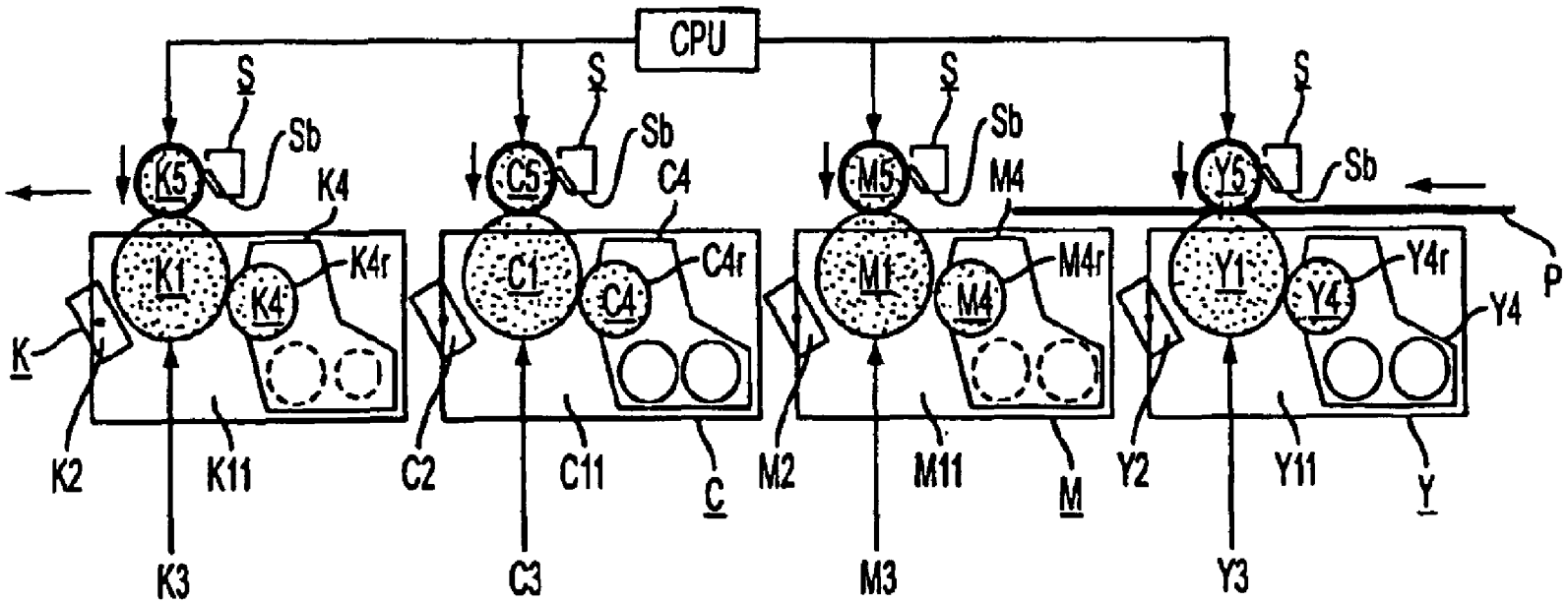
FIG. 9 is a schematic illustration showing peripheral arrangement of image forming stations of yet another embodiment of an image forming apparatus according to the present invention.

Although the above-described image forming apparatus has a transfer belt (or an intermediate transfer belt) serving as an intermediate transfer member to which a toner image formed on the photosensitive surface is transferred and which holds such toner image thereon and then transfers the toner image to a sheet, it is not limited to the described structure, but the transfer belt may be substituted by a transfer roller pressing a sheet against the photosensitive surface to transfer a toner image formed on the photosensitive surface to the sheet, and hence the belt surface is substituted by the roller surface of the transfer roller. This embodiment is shown in FIG. 9.

It may also be so arranged that the relation of electric field intensity between the photosensitive surface and the belt surface or the absolute value of the electric field intensity is changed in accordance with information regarding the image coverage rate, cumulative image coverage rate or color mixing.

Furthermore, in the above-described image forming apparatus, there should preferably be provided a transfer bias voltage control (or CPU not shown in the drawings) for applying a transfer bias voltage in transferring a toner image formed on the photosensitive surface so that a transfer bias voltage in an image forming station is lower than that in an image forming station located upstream thereof as views in the moving direction of the belt surface when the coverage rate at the upstream image forming station is higher than that at the downstream image forming station.

Thus, setting the transfer bias voltage in the downstream image forming station lower than that in the upstream image forming station when the coverage rate at the upstream image forming station is higher than that at the downstream image forming station (or in case of printing an image of such a type that tends to cause color mixing) can inhibit the occurrence of reverse transfer due to a high transfer bias voltage and hence prevent color toner mixing.

Still furthermore, in the above-described image forming apparatus, there may be provided a transfer bias voltage control for applying a transfer bias voltage in transferring a toner image formed on the photosensitive surface, which transfer bias voltage control is operable in such a way that a transfer bias voltage in an image forming station is higher than that in an image forming station located upstream thereof as views in the moving direction of the belt surface when the coverage rate at the upstream image forming station is lower than that at the downstream image forming station.

Thus, setting the transfer bias voltage in the downstream image forming station higher than that in the upstream image forming station when the coverage rate at the upstream image forming station is lower than that at the downstream image forming station (or in case of printing an image of such a type that does not tends to cause color mixing) can inhibit the occurrence of reverse transfer due to a high transfer bias voltage and hence prevent color toner mixing.

As mentioned in earlier part hereof, in each of the above-described embodiments, the contact pressure in terms of line pressure between the photosensitive surface and the belt surface should preferably be 1 g/cm or more, but less than 50 g/cm.

Additionally, in each of the above-described embodiments, there may be provided a transfer bias voltage control for applying a transfer bias voltage in transferring a toner image formed on the photosensitive surface, which transfer bias voltage control is operable in such a way that it applies a voltage at least one of the voltage value and the polarity of which is different from the transfer bias voltage during a time when transferring of the toner image from the photosensitive surface is not being performed.

By so constructing the apparatus, substances (such as toner, dirt, etc.) which are attached to the photosensitive surface by charging and causes filming on photoreceptor can be easily removed therefrom, with the result that filming on photoreceptor can be effectively inhibited.

As have been described in detail, the present invention can provide an image forming apparatus which is capable of inhibiting filming on photoreceptor and color toner mixing, while prolonging the life of the photoreceptor.

What is claimed is:

1. An image forming apparatus comprising:

an image carrier having an image carrier surface carrying thereon an electrostatic latent image;

a developing device for forming a toner image on said image carrier surface and electrically recovering toner remaining on said image carrier surface after image forming operation at said image carrier;

a contact member having a contact surface which is in contact engagement with said image carrier surface; and a cleaner for removing toner attached on said contact surface;

wherein the contact angle of said image carrier surface for water is greater than that of said contact surface for water, wherein said contact member comprises a transfer mechanism which is operable to press a sheet against said image carrier surface.

2. An image forming apparatus according to claim 1, further comprising:

a transfer bias voltage control for applying a transfer bias voltage in transferring the toner image formed on said image carrier surface; and wherein said transfer bias voltage control is operable to apply a voltage, at least one of the voltage value and the polarity thereof being different from said transfer bias voltage, during a time when transferring of the toner image from said image carrier surface is not being performed.

3. An image forming apparatus according to claim 1, wherein said transfer mechanism comprises a transfer roller which is operable to press a sheet against said image carrier surface to transfer the toner image formed on said image carrier surface to said sheet, and wherein said contact surface is provided by a roller surface of said transfer roller.

4. An image forming apparatus according to claim 1, wherein the contact pressure in terms of line pressure between said image carrier surface and said contact surface is 1 g/cm or more, but less than 50 g/cm.

5. An image forming apparatus according to claim 1, wherein said transfer mechanism comprises a transfer belt which is operable to press a sheet against said image carrier surface to transfer the toner image formed on said image carrier surface to said sheet, and wherein said contact surface is provided by a surface of said transfer belt.

6. An image forming apparatus comprising:

an image carrier having an image carrier surface carrying thereon an electrostatic latent image;

a developing device for forming a toner image on said image carrier surface and electrically recovering toner remaining on said image carrier surface alter image forming operation at said image carrier;

a contact member having a contact surface which is in contact engagement with said image carrier surface; and a cleaner for removing toner attached on said contact surface;

wherein the contact angle of said image carrier surface for water is greater than that of said contact surface for water, wherein said contact member comprises a transfer belt to which the toner image formed on said image carrier surface is transferred and which holds such toner image and then transfers such held toner image to a sheet, and wherein said contact surface is provided by a transfer surface of said transfer belt.

7. An image forming apparatus comprising:

a plurality of image forming stations each comprising an image carrier having a movable image carrier surface for carrying thereon an electrostatic latent image and a developing device for forming a toner image on said image carrier surface and electrically recovering toner remaining on said image carrier surface after image forming operation on said image carrier;

a contact member having a contact surface movable while contacting with said image carrier surface of each image forming station;

a cleaner for removing toner attached on said contact surface; and wherein the contact angle of said image carrier surface for water is greater than that of said contact surface for water, wherein said contact member comprises a transfer mechanism which is operable to press a sheet against said image carrier surface.

8. An image forming apparatus according to claim 7, further comprising a transfer bias voltage control for applying a transfer bias voltage in transferring the toner image formed on said image carrier surface, and wherein said transfer bias voltage control is operable to apply a voltage, at least one of the voltage value and the polarity thereof being different from said transfer bias voltage, during a time when transferring of the toner image from said image carrier surface is not being performed.

9. An image forming apparatus according to claim 7, wherein said transfer mechanism comprises a transfer roller which is operable to press a sheet against said image carrier surface to transfer the toner image formed on said image carrier surface to said sheet, and wherein said contact surface is provided by a roller surface of said transfer roller.

10. An image forming apparatus according to claim 7, wherein the contact pressure in terms of line pressure between said image carrier surface and said contact surface is 1 g/cm or more, but less than 50 g/cm.

11. An image forming apparatus according to claim 7, wherein said transfer mechanism comprises a transfer belt which is operable to press a sheet against said image carrier surface to transfer the toner image formed on said image carrier surface to said sheet, and wherein said contact surface is provided by a surface of said transfer belt.

12. An image forming apparatus comprising:

a plurality of image forming stations each comprising an image carrier having a movable image carrier surface for carrying thereon an electrostatic latent image and a developing device for forming a toner image on said image carrier surface and electrically recovering toner remaining on said image carrier surface after image forming operation on said image carrier;

a contact member having a contact surface movable while contacting with said image carrier surface of each image forming station;

a cleaner for removing toner attached on said contact surface; and a transfer bias voltage control for applying a transfer bias voltage in transferring the toner image formed on said image carrier surface, and wherein the contact pressure between said image carrier surface and said contact surface of an image forming station located on the upstream side with respect to the moving direction of said contact surface is lower than that of another image forming station located on the downstream side, and wherein the transfer bias voltage for the upstream image forming station is greater than that for the downstream image forming station, wherein the contact angle of said image carrier surface for water is greater than that of said contact surface for water.

13. An image forming apparatus comprising:

a plurality of image forming stations each comprising an image carrier having a movable image carrier surface for carrying thereon an electrostatic latent image and a developing device for forming a toner image on said image carrier surface and electrically recovering toner remaining on said image carrier surface after image forming operation on said image carrier;

a contact member having a contact surface movable while contacting with said image carrier surface of each image forming station;

a cleaner for removing toner attached on said contact surface; and wherein the contact angle of said image carrier surface for water is greater than that of said contact surface for water, wherein the contact pressure between said image carrier surface and said contact surface of an image forming station located on the upstream side with respect to the moving direction of said contact surface is greater than that of another image forming station located on the downstream side.

14. An image forming apparatus according to claim 13, further comprising a transfer bias voltage control for applying a transfer bias voltage in transferring the toner image formed on said image carrier surface, and wherein the transfer bias voltage for the image forming station located on the upstream side with respect to the moving direction of said contact surface is lower than that for the downstream image forming station.

15. An image forming apparatus comprising:

a plurality of image forming stations each comprising an image carrier having a movable image carrier surface for carrying thereon an electrostatic latent image and a developing device for forming a toner image on said image carrier surface and electrically recovering toner remaining on said image carrier surface after image forming operation on said image carrier;

a contact member having a contact surface movable while contacting with said image carrier surface of each image forming station;

a cleaner for removing toner attached on said contact surface; and wherein the contact angle of said image carrier surface for water is greater than that of said contact surface for water, wherein said contact member comprises a transfer belt to which the toner image formed on said image carrier surface is transferred and which holds such toner image and then transfers the held toner image to a sheet, and wherein said contact surface is provided by a transfer surface of said transfer belt.

16. An image forming apparatus comprising:

a plurality of image forming stations each comprising an image carrier having a movable image carrier surface for carrying thereon an electrostatic latent image and a developing device for forming a toner image on said image carrier surface and electrically recovering toner remaining on said image carrier surface after image forming operation on said image carrier;

a contact member having a contact surface movable while contacting with said image carrier surface of each image forming station;

a cleaner for removing toner attached on said contact surface; and a transfer bias voltage control for applying a transfer bias voltage in transferring the toner image formed on said image carrier surface, and wherein, when the coverage rate for an image forming station located on the upstream side with respect to the moving direction of said contact surface is higher than that for another image forming station located on the downstream side, and wherein said transfer bias voltage control is operable to apply to said downstream image forming station a transfer bias voltage which is lower than that applied to said upstream image forming station, wherein the contact angle of said image carrier surface for water is greater than that of said contact surface for water.

17. An image forming apparatus comprising:

a plurality of image forming stations each comprising an image carrier having a movable image carrier surface for carrying thereon an electrostatic latent image and a developing device for forming a toner image on said image carrier surface and electrically recovering toner remaining on said image carrier surface after image forming operation on said image carrier;

a contact member having a contact surface movable while contacting with said image carrier surface of each image forming station;

a cleaner for removing toner attached on said contact surface; and a transfer bias voltage control for applying a transfer bias voltage in transferring the toner image formed on said image carrier surface, and wherein, when the coverage rate for an image forming station located on the upstream side with respect to the moving direction of said contact surface is lower than that for another image forming station located on the downstream side, and wherein said transfer bias voltage control is operable to apply to said downstream image forming station a transfer bias voltage which is higher than that applied to the upstream image forming station, wherein the contact angle of said image carrier surface for water is greater than that of said contact surface for water.

* * * * *